US010788773B2

(12) United States Patent
Furukawa

(10) Patent No.: US 10,788,773 B2
(45) Date of Patent: Sep. 29, 2020

(54) TRANSFER BELT, TRANSFER UNIT, AND IMAGE FORMATION APPARATUS

(71) Applicant: Oki Data Corporation, Tokyo (JP)

(72) Inventor: Takaaki Furukawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/705,224

(22) Filed: Dec. 6, 2019

(65) Prior Publication Data

US 2020/0264541 A1 Aug. 20, 2020

(30) Foreign Application Priority Data

Feb. 15, 2019 (JP) ..... 2019-026005

(51) Int. Cl.
*G03G 15/16* (2006.01)
*G03G 15/00* (2006.01)

(52) U.S. Cl.
CPC ..... *G03G 15/1685* (2013.01); *G03G 15/6529* (2013.01); *G03G 15/1625* (2013.01)

(58) Field of Classification Search
CPC ..... G03G 15/162; G03G 15/1685; G03G 2215/0193; G03G 2215/1623
See application file for complete search history.

(56) References Cited

U.S. PATENT DOCUMENTS

2007/0122181 A1* 5/2007 Kamijo ..... G03G 15/161 399/101
2010/0054782 A1* 3/2010 Sakka ..... G03G 15/162 399/66
2012/0224892 A1* 9/2012 Takazawa ..... G03G 15/162 399/302

FOREIGN PATENT DOCUMENTS

JP 2017-68162 A 4/2017

* cited by examiner

*Primary Examiner* — Thomas S Giampaolo, II
(74) *Attorney, Agent, or Firm* — Metrolex IP Law Group, PLLC

(57) ABSTRACT

A transfer belt according to one or more embodiments may include a surface to which a developer image is to be transferred and from which the transferred developer image is to be transferred from to a medium. The transfer belt may be configured having characteristics in which a dipole component of the surface of the transfer belt is not less than 0.3 dyn/cm and not larger than 1.9 dyn/cm.

7 Claims, 4 Drawing Sheets

FIG. 4

| SAMPLE | | 1 | 2 | 3 | 4 | 5 | 6 | 7 | 8 | 9 | 10 | 11 | 12 |
|---|---|---|---|---|---|---|---|---|---|---|---|---|---|
| STATIC FRICTION COEFFICIENT μ (AGAINST SUS) | | 0.21 | 0.14 | 0.31 | 0.22 | 0.14 | 0.16 | 0.15 | 0.28 | 0.33 | 0.21 | 0.25 | 0.31 |
| CONTACT ANGLE | WATER | 100 | 1.5 | 100 | 98 | 85 | 101 | 97 | 99 | 103 | 98 | 82 | 98 |
| | IODOMETHANE | 82 | 77 | 74 | 69 | 56 | 761 | 72 | 67 | 89 | 74 | 66 | 74 |
| | N-DODECANE | 21 | 21 | 22 | 30 | 11 | 21 | 28 | 24 | 52 | 36 | 29 | 36 |
| γp: DIPOLE COMPONENT | | 5.2 | 1.1 | 0.2 | 1.6 | 7.6 | 0.6 | 0.2 | 1.6 | 1.0 | 1.9 | 3.1 | 0.3 |
| γd: DISPERSION COMPONENT | | 23.7 | 23.7 | 23.6 | 22.0 | 24.9 | 23.7 | 22.5 | 23.2 | 16.5 | 25.0 | 22.4 | 20.7 |
| γh: HYDROGEN BONDING COMPONENT | | 1.0 | 0.1 | 0.5 | 0.6 | 2.3 | 0.4 | 0.8 | 0.2 | 1.3 | 0.0 | 4.4 | 0.9 |
| γ: SURFACE FREE ENERGY | | 29.9 | 24.9 | 24.3 | 24.2 | 34.8 | 24.8 | 23.5 | 25.1 | 18.8 | 26.9 | 29.9 | 21.8 |
| GLUE ADHESION | | C | A | A | A | C | A | A | A | A | A | C | A |
| GLUE SPREAD | | A | A | C | A | A | A | A | A | C | A | A | C |
| TRANSFERABILITY | | A | A | C | A | A | A | C | A | A | A | A | A |
| WEAR OF CLEANING BLADE | | A | A | C | A | A | A | A | C | C | A | A | C |
| OVERALL EVALUATION | | C | S | C | S | C | S | C | A | B | S | C | B |

TRANSFER BELT, TRANSFER UNIT, AND IMAGE FORMATION APPARATUS

CROSS REFERENCE TO RELATED APPLICATIONS

This application claims priority based on 35 USC 119 from prior Japanese Patent Application No. 2019-026005 filed on Feb. 15, 2019, entitled "TRANSFER BELT, TRANSFER UNIT, AND IMAGE FORMATION APPARATUS", the entire contents of which are incorporated herein by reference.

BACKGROUND

This disclosure may relate to a transfer belt, a transfer unit, and an image formation apparatus.

In a related art, there is an intermediate transfer type image formation apparatus as one of electrophotographic type image formation apparatuses. In such an intermediate transfer type image formation apparatus, a developer image formed on a photosensitive drum as an image carrier is transferred to a transfer belt, and then the developer image transferred to the transfer belt is transferred to a medium such as paper (For example, Document 1).

Document 1: Japanese Patent Application Publication No. 2017-68162

SUMMARY

However, in the related art, when a medium having a glue attached thereto such as a label paper is used for printing, for example, the glue may be transferred from the medium to the transfer belt in contact with the medium and thus be adhered to the transfer belt.

An object of an embodiment of the disclosure may be to propose a transfer belt, a transfer unit, and an image formation apparatus capable of suppressing adhesion of a glue to the transfer belt.

An aspect of an embodiment may be a transfer belt that includes a surface on which a developer image is to be transferred and from which the transferred developer image is to be transferred to a medium. The transfer belt comprises characteristics in which a dipole component of the surface of the transfer belt is not less than 0.3 dyn/cm and not larger than 1.9 dyn/cm.

According to the aspect described above, it may be possible to suppress a glue from being transferred and adhered from a medium to the transfer belt in contact with the medium.

Therefore, it may be possible to realize a transfer belt, a transfer unit, and an image formation apparatus capable of suppressing adhesion of a glue to the transfer belt.

BRIEF DESCRIPTION OF DRAWINGS

FIG. 4 is a table illustrating experimental results conducted to define a range of a dipole component of a transfer belt surface and a range of a static friction coefficient of the transfer belt surface.

DETAILED DESCRIPTION

Figure 1:
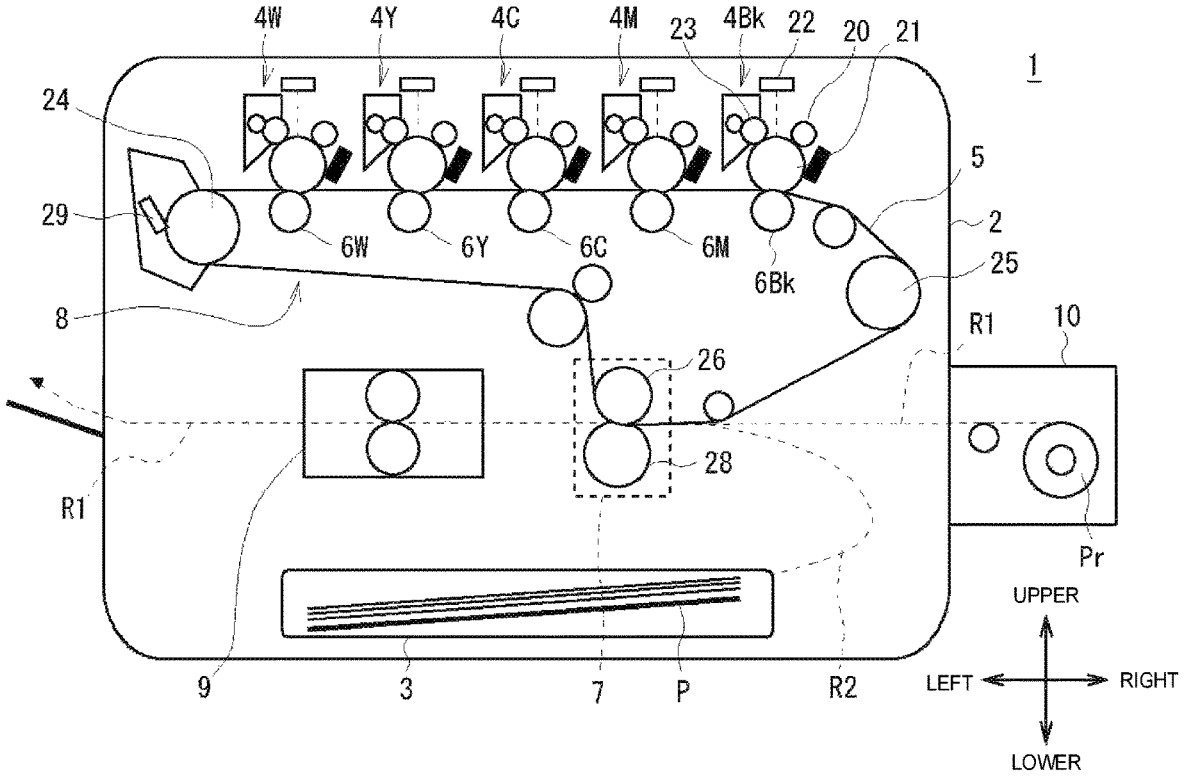
FIG. 1 is a diagram illustrating a view of a configuration of an image formation apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Configuration of Image Formation Apparatus

FIG. 1 is a diagram illustrating a view of an internal configuration of an image formation apparatus 1 according to one or more embodiments. The image formation apparatus 1 according to an embodiment is an intermediate transfer type color printer capable of printing on various media such as copy paper, label paper, roll paper, and the like. The image formation apparatus 1 has a housing 2 formed in a substantially box-shaped, for example. In this disclosure, a direction from a front side to a back side of the housing 2 is referred to as a back or rear direction, an direction opposite to the rear direction is referred to as a front direction, a direction from a right side to a left side of the housing 2 is referred to as a left direction, a direction opposite to the left direction is referred to as a right direction, a direction from a lower side to an upper side of the housing 2 is referred to as an upward or upper direction, and a direction opposite to the upward direction is referred to as a downward or lower direction.

The image formation apparatus 1 includes: a medium accommodation unit 3 (for example, a sheet cassette) that accommodates therein media P such as copy paper, label paper, or the like; medium conveyance paths R (R1, R2); a plurality of (for example, five) image formation units 4 (4W, 4Y, 4C, 4M, and 4Bk) serving as an image formation section; a transfer unit 8 including a transfer belt 5, a primary transfer roller 6 (6W, 6Y, 6C, 6M, and 6Bk), a secondary transfer part 7 and the like; and a fixation device 9. A feeding unit 10, serving as a medium feeder, is attached to the right surface of the housing 2. The feeding unit 10 unwinds a rolled medium Pr such as label paper, roll paper, or the like and feeds the medium Pr to the housing 2.

The medium conveyance path R1 is provided in a central portion in a vertical direction inside the housing 2. The medium conveyance path R1 is connected to the feeding unit 10 provided on the right side of the housing 2 and extends in the left-right direction from the right surface to the left surface of the housing 2. The secondary transfer part 7 and the fixation device 9 are provided in the housing 2 in that order from the upstream side to the downstream side in the medium conveyance direction (from the right side to the left side in FIG. 1) along the medium conveyance path R1.

In the housing 2, the medium accommodation unit 3 is provided below the medium conveyance path R1. Inside the housing 2, the medium conveyance path R2 is also provided which connects the medium accommodation unit 3 and a part of the medium conveyance path R1 upstream from the secondary transfer part 7 in the medium conveyance direction. The image formation apparatus 1 can unwind the roll of the medium Pr in the feeding unit and feed the medium Pr from the feeding unit 10 to the secondary transfer part 7 along the medium conveyance path R 1, and also can feed the medium R from the medium accommodation unit 3 to the secondary transfer part 7 along the medium conveyance path R2.

The five image formation units 4 (4W, 4Y, 4C, 4M, and 4Bk) are arranged in the left-right direction in the upper part in the housing 2. The transfer belt 5 is provided between the medium conveyance path R1 and the five image formation units 4 (4W, 4Y, 4C, 4M, and 4Bk).

The five image formation units 4 (4W, 4Y, 4C, 4M, and 4Bk) respectively correspond to white, yellow, cyan, magenta, and black toners (developers). The five image formation units 4 (4W, 4Y, 4C, 4M, and 4Bk) have the same configuration except for the colors of the toners. Each image formation unit 4 includes a charging roller 20, a photosensitive drum 21 as an image carrier, an LED head 22, and a developing roller 23.

Each image formation unit 4 uniformly charges a surface of the photosensitive drum 21 with the charging roller 20 and then the LED head 22 emits lights onto the surface of the photosensitive drum 21, so that an electrostatic latent image is formed on the surface of the photosensitive drum 21. Each image formation unit 4 develops the electrostatic latent image formed on the surface of the photosensitive drum 21 with the toner supplied by the developing roller 23, thereby forming a toner image (serving as a developer image) on the surface of the photosensitive drum 21.

The primary transfer rollers 6 (6W, 6Y, 6C, 6M, and 6Bk) are respectively arranged below and opposed to the photosensitive drums 21 of the five image formation units 4 (4W, 4Y, 4C, 4M, and 4Bk), with the transfer belt 5 interposed therebetween. The toner images formed on the photosensitive drums 21 of the image formation units 4 are sequentially transferred (primary transfer) to the surface of the transfer belt 5 by means of the primary transfer rollers 6.

Figure 2:
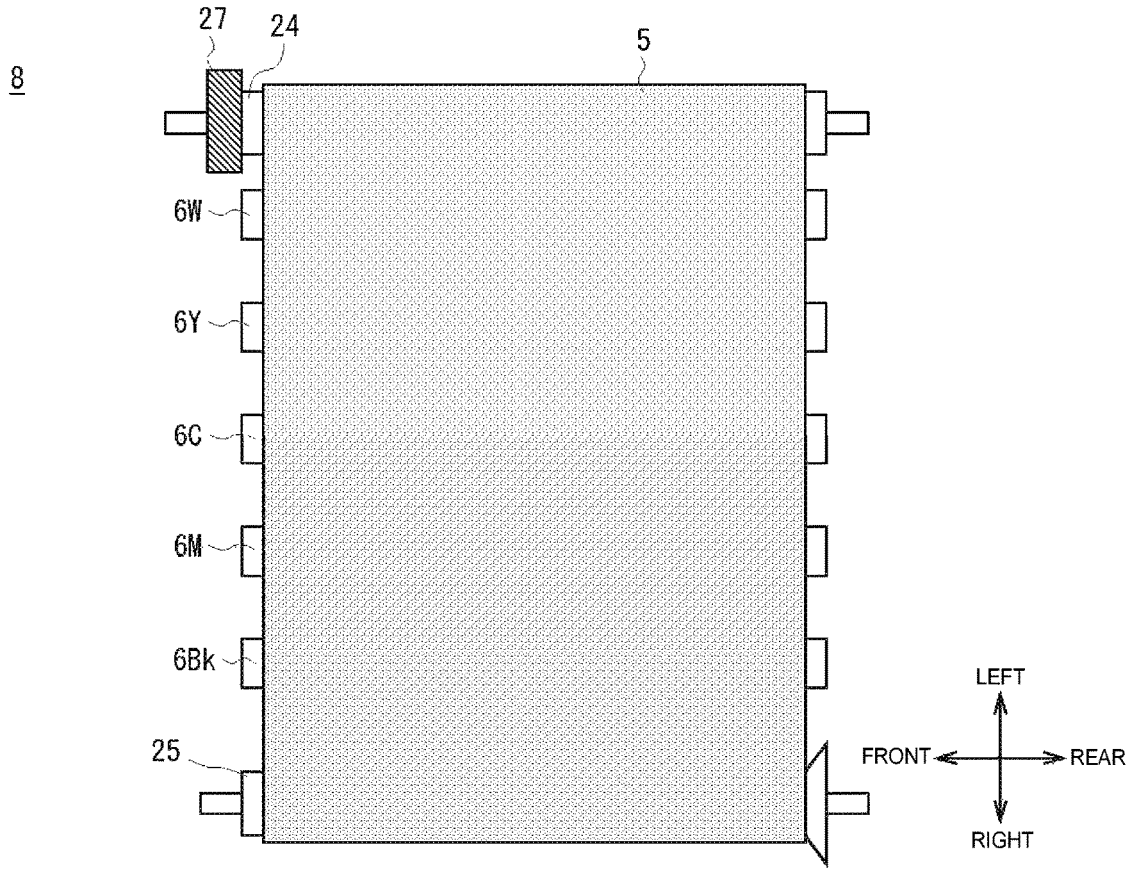
FIG. 2 is a diagram illustrating a view of a configuration of a transfer unit according to one or more embodiments.

The transfer belt 5 is annular or tubular. Various rollers such as a drive roller 24, an idle roller 25, and a secondary transfer roller 26 of the secondary transfer part 7 are provided inside (that is, the back side) of the transfer belt 5 to stretch the annular transfer belt 5, so that the transfer belt 5 forms in a substantially inverted triangular shape having the upper side thereof being flat and the lower side thereof being protruded downwardly. As illustrated in FIG. 2, which illustrates the top view of the transfer unit 8, the drive roller 24 is located on the leftmost position among the various rollers provided in the transfer belt 5 and is connected through a gear 27 to a motor (not illustrated), and the idle roller 25 is located on the rightmost position among the various rollers. As illustrated in FIG. 1, the secondary transfer roller 26 is positioned on the lowermost position among the various rollers. A backup roller 28 of the secondary transfer part 7 is disposed below and opposed to the secondary transfer roller 26 with the transfer belt 5 interposed between backup roller 28 and the secondary transfer roller 26. Note that the drive roller 24, the idle roller 25, the secondary transfer roller 26, the gear 27, and the backup roller 28 are included in the transfer unit 8.

The transfer belt 5 has an upper flat portion that passes between the photosensitive drum 21 of each image formation unit 4 and each primary transfer roller 6. The color toner images formed on the photosensitive drums 21 are transferred (primary transfer) to the upper side of the flat portion of the transfer belt 5 (that is, the upper surface of the transfer belt 5, or the outer peripheral surface of the transfer belt 5).

The toner images that are transferred to the transfer belt 5 are then conveyed to the secondary transfer part 7 as the transfer belt 5 travels in the clockwise direction in FIG. 1. A nip portion is provided (defined) between the secondary transfer roller 26 and the backup roller 28 of the secondary transfer part 7 along the medium conveyance path R1. When the medium P from the medium accommodation unit 3 or the medium Pr from the feeding unit 10 is passing through the nip portion, the toner images conveyed by the transfer belt 5 is transferred (secondary transfer) to the medium P or the medium Pr.

The medium P or the medium Pr having the toner images transferred thereon is conveyed to the fixation device 9 along the medium conveyance path R1. The fixation device 9 fixes the toner images on the medium P or the medium Pr by heating and pressurizing the medium P or the medium Pr. Thereafter, the medium P or the medium Pr having the toner images fixed thereon is discharged to the outside of the housing 2.

A cleaning blade 29 is provided in the housing 2 at a position facing the drive roller 24 with the transfer belt 5 interposed between the drive roller 24 and the cleaning blade 29. The cleaning blade 29 is for example formed of urethane, and the tip of the cleaning blade is pressed against the surface of the transfer belt 5 with a constant pressure. The cleaning blade 29 scrapes off residual toner remaining on the surface of the transfer belt 5 after the secondary transfer, to thereby remove the residual toner from the surface of the transfer belt 5. The cleaning blade 29 may be a part of the transfer unit 8 or may not be a part of the transfer unit 8. The image formation apparatus 1 is configured as described above.

As described above, the image formation apparatus 1 primarily transfers the toner images formed by the image formation units 4 (4W, 4Y, 4C, 4M, and 4Bk) onto the surface of the transfer belt 5, secondarily transfers the toner images from the transfer belt 5 onto the medium P or the medium P, fixes the toner images onto the medium P or the medium Pr by the fixation device 9, and then discharges the medium P or the medium Pr having the image thereon to the outside of the image formation apparatus 1.

By the way, in a case where label paper including a backing sheet and labels attached to the backing sheet with a glue is used in such an intermediate transfer type image formation apparatus 1, the glue that sticks out of the cut lines defining the labels to the surface of the label paper may be transferred to and adhered to the surface of the transfer belt 5, when the label paper passes through the secondary transfer part 7.

If the glue is adhered to the transfer belt 5 and is conveyed by the transfer belt 5 to the image formation units 4, the toner images transferred from the image formation units 4 to the transfer belt 5 may have image defects.

Therefore, the image formation apparatus 1 according to one or more embodiments have a configuration that makes it difficult for the glue contained in the label paper to be adhered to the surface of the transfer belt 5, and makes it easy to remove the glue attached to the surface of the transfer belt 5 by the cleaning blade 29.

Specifically, the image formation apparatus 1 according to one or more embodiments have a specific range of a dipole component of the surface of the transfer belt 5 (one of components constituting the surface energy), and a specific range of a static friction coefficient of the surface of the transfer belt 5, to make it difficult for the glue of the label paper to be adhered to the surface of the transfer belt 5 and make it easy to remove the glue attached to the surface of the transfer belt 5 by the cleaning blade 29. The specific range of the dipole component of the surface of the transfer belt 5 and the specific range of the static friction coefficient of the surface of the transfer belt 5 are described blow in detail.

2. Ranges of Dipole Component and Static Friction Coefficient of Transfer Belt Surface First, a reason for paying attention to the dipole component on the surface of the transfer belt 5 is describe below. The fact that the glue is adhered to the surface of the transfer belt 5 means that an intermolecular force occurs between the surface of the transfer belt 5 and the glue, which attracts each other. Note that a molecular energy of the surface of the transfer belt 5 is referred to as a surface energy or a surface free energy.

The surface energy is mainly composed of three components: a dipole component, a hydrogen bonding component, and a dispersion force component. Assuming that the surface energy is $\gamma$, the dipole component is $\gamma p$, the hydrogen bonding component is $\gamma h$, and the dispersion component is $\gamma d$, a magnitude of the surface energy $\gamma$ can be expressed by the following equation: $\gamma=\gamma p+\gamma h+\gamma d$.

Of the three components, the dipole component ($\gamma p$) is a component by which the molecules pull each other in the positive and negative directions because the polar molecules are polarized by the positive and negative electrons due to the permanent dipoles.

The hydrogen bonding component ($\gamma h$) is a component by which a hydrogen atom is bonded to an atom having a high electron donating property of another molecule due to the strong polarity between the hydrogen atom and the atom having the large electronegativity.

The dispersion force component ($\gamma d$) is a component by which the molecules pull each other based on instantaneous polarization due to vibrations of the electrons in all of the molecules.

These three components (the dipole component $\gamma p$, the hydrogen bonding component $\gamma h$, and the dispersion component $\gamma d$) are considered to act when the glue is adhered to the surface of the transfer belt 5.

On the other hand, in an embodiment, the glue on the label paper is an acrylic adhesive. Because the acrylic has a high polarity, it may be estimated that the dipole component ($\gamma p$) among the three components, which is a component in which the polar molecules are attracted to each other, is mainly acting when the glue is adhered to the surface of the transfer belt 5. Therefore, it is considered that a specific range of the dipole component on the surface of the transfer belt 5 makes it difficult for the glue to be adhered to the surface of the transfer belt 5. This is the reason for paying attention to the dipole component on the surface of the transfer belt 5.

Note that a method of changing the dipole component on the surface of the transfer belt 5 may include: a method of adding a resin layer having polarity to the surface of the transfer belt 5 to form a two layered transfer belt; and a method of adding a coat having polarity to the surface of the transfer belt 5 to coat the surface of the transfer belt 5. For example, if the transfer belt 5 has a two layered structure with a resin layer having a larger polarity as the surface layer of the transfer belt 5, the polarity of the surface layer of the two-layered transfer belt 5 becomes large, which thus increases the dipole component thereof. For example, if the transfer belt 5 is coated on the surface of the transfer belt 5 by adding a coat having a smaller polarity, the polarity of the surface layer (coating layer) of the transfer belt 5 becomes small, which thus decreases the dipole component thereof.

Examples of a resin or coat having a large polarity include those containing a hydroxyl group, a carboxyl group, and an amino group. Examples of a resin or coat having a low polarity include those containing a hydroxyl group, a carboxyl group, and an amino group.

Next, a reason for paying attention to the static friction coefficient of the surface of the transfer belt 5 is described below in detail. The glue that is adhered to the surface of the transfer belt 5 when passing through the secondary transfer part 7 is in a state of being lightly attached on the surface of the transfer belt 5. Therefore, as illustrated in the enlarged view in FIG. 3, when the glue 30 is conveyed to the cleaning blade 29 by the transfer belt 5, the glue 30 is blocked by the tip of the cleaning blade 29 and is deposited on and near the tip of the cleaning blade 29.

Thereafter, when the transfer belt 5 is started to travel after a temporal stop, a static friction force larger than a dynamic friction force during the travel is applied to the transfer belt 5 by the cleaning blade 29. If the static frictional force is large, the glue 30 deposited on and near the tip of the cleaning blade 29 is rubbed by the tip of the cleaning blade 29 so as to be spread (thinly stretched) on the surface of the transfer belt 5 while being passed through between the tip of the cleaning blade 29 and the transfer belt 5.

Accordingly, the magnitude of the static friction force acting on the transfer belt 5 is an important factor to reliably remove the glue 30 attached to the surface of the transfer belt 5 by the cleaning blade 29. It is thus considered that if the static friction coefficient of the surface of the transfer belt 5 (against stainless steel "SUS") is set within a specific range, it become easy to remove the glue attached to the surface of the transfer belt 5 by the cleaning blade 29. This is the reason for paying attention to the static friction coefficient of the surface of the transfer belt 5 (against SUS).

Note that the static friction coefficient is an empirical parameter determined by two materials in contact with each other. In an embodiment, the two materials are the transfer belt 5 composed mainly of polyamideimide resin and the cleaning blade 29 formed of urethane. Therefore, it may be preferable to determine a range of the static friction coefficient of the surface of the transfer belt 5 against urethane rather than a range of the static friction coefficient of the surface of the transfer belt 5 against SUS. However, it is difficult to measure the static friction coefficient between polyamideimide resin and urethane. Thus, the range of the static friction coefficient of the transfer belt 5 against SUS, which is generally used for measurements of the static friction coefficient, is determined based on experimental results described below.

Next, experiments conducted to determine the range of the dipole component on the surface of the transfer belt 5 and the range of the static friction coefficient of the surface of the transfer belt 5 (against SUS) are described below. The experimental results are illustrated in the table in FIG. 4. As illustrated in FIG. 4, in the experiments, twelve samples (Sample Nos. 1 to 12) of the transfer belt 5 having different surface dipole components and static friction coefficients (against SUS) are prepared. Four items are evaluated after the image forming apparatus 1 performs printing using each of the samples of the transfer belt 5: glue adhesion to the surface of the transfer belt 5; glue spread on the surface of the transfer belt 5; transferability to the surface of the transfer belt 5; and wear of the cleaning blade 29.

The dipole component of each of the twelve samples of the transfer belt 5 is obtained by measuring, with a measuring machine, contact angles of water, iodomethane, and n-dodecane droplets on the surface of each of the samples of the transfer belt 5, and executing calculation based on the measurement results of the contact angles. The static friction coefficient of each of the twelve samples of the transfer belt 5 (against SUS) is measured with a friction meter in a state where the SUS surface in contact with the surface of the transfer belt 5. The unit of the dipole component in FIG. 4 is dyn/cm.

Evaluation on the glue adhesion on the surface of each of the sample transfer belt 5, which is one of the four evaluation items, is performed by visually checking whether or not the glue has adhered to the surface of the transfer belt 5 after performing printing on one rolled label paper. Specifically, if it is confirmed by visual check that there is no glue adhered to the surface of the transfer belt 5, it is determined to be no glue adhesion (marked with "A" in FIG. 4). If it is confirmed by visual check that the there is a glue adhered to the surface of the transfer belt 5, it is determined to be a glue adhesion (marked with "C" in FIG. 4).

Evaluation on the glue spread on the surface of the transfer belt 5 is performed by attaching a glue on the surface of the transfer belt 5 in advance, executing printing using the transfer belt 5 on which the glue is attached, and checking by visual check whether or not the glue attached to the surface of the transfer belt 5 is spread (thinly stretched) on the surface of the transfer belt 5. Specifically, if it is confirmed by visual check that there is no glue spread against the surface of the transfer belt 5, it is determined to be no glue spread (marked with "A" in FIG. 4), and if it is confirmed by visual check that there is the glue spread against the surface of the transfer belt 5, it is determined that there is a glue spread (marked with "C" in FIG. 4). Note that the spread of the glue against the surface of the transfer belt 5 means that the glue adhered to the surface of the transfer belt 5 passes through between the tip of the cleaning blade 29 and the transfer belt 5 while being rubbed against the surface of the transfer belt 5 by the cleaning blade 29.

The transferability to the surface of the transfer belt 5 is evaluated based on the fact that what percentage of the toner on the photosensitive drum 21 is transferred to the transfer belt 5 when the toner image formed on the photosensitive drum 21 is transferred to the surface of the transfer belt 5 (that is, the toner transfer rate). Specifically, the weight of the toner adhered to the photosensitive drum 21 before the toner image is transferred to the transfer belt 5 (hereinafter referred to as Wb), and the weight of the toner remaining on the photosensitive drum 21 after the toner image is transferred to the transfer belt 5 (hereinafter referred to as Wa) are measured, and the toner transfer rate is calculated based on the formula $(Wb-Wa)/Wb\times100$. If the toner transfer rate is 70% or more, it is determined that the transferability is good (marked with "A" in FIG. 4), and if the transfer rate is less than 70%, it is determined that the transferability is poor (marked with "C" in FIG. 4). Note that the toner weights Wb and Wa can be measured using a dedicated jig.

Figure 3:
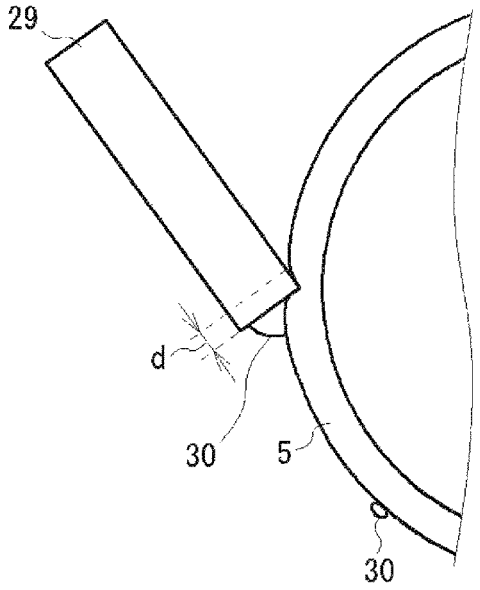
FIG. 3 is a diagram illustrating an enlarged view of a cleaning blade and its peripheral parts according to one or more embodiments.

The wear of the cleaning blade 29 is evaluated by measuring a wear height of the cleaning blade 29 with a microscope after printing one rolled paper. As illustrated in FIG. 3, the wear height of the cleaning blade 29 is the length "d" of the portion worn from the distal end side of the cleaning blade 29 toward the proximal side of the cleaning blade 29. If the wear height of the cleaning blade 29 is 15 μm or less, it is determined that the height of the wear is low (marked with "A" in FIG. 4), and if the wear height exceeds 15 μm, the height of the wear is high (marked with "C" in FIG. 4).

Each of the twelve samples of the transfer belt 5 is comprehensively evaluated based on the determination results of the above four items. Specifically, the sample transfer belt 5 whose evaluation on all four items are good (marked with "A" in FIG. 4) is judged as excellent (marked with "S" in FIG. 4) on the overall evaluation. The sample transfer belt 5 whose evaluation on all four items are good (marked with "A" in FIG. 4) except for the wear of the cleaning blade 29 being poor (marked with "C" in FIG. 4) is evaluated as good (marked with "A" in FIG. 4) on the overall evaluation. The sample transfer belt 5 whose evaluations on only the glue spread on the surface of the transfer belt 5 and the wear of the cleaning blade 29 in the four items are evaluated as poor (marked with "C" in FIG. 4) is judged as slightly good (marked with "B" in FIG. 4). The sample transfer belt 5 whose evaluation on at least one of the glue adhesion to the surface of the transfer belt 5 and the transferability to the surface of the transfer belt 5 is poor (marked with "C" in FIG. 4) is judged as poor (marked with "C" in FIG. 4) on the overall evaluation.

Figure 5:
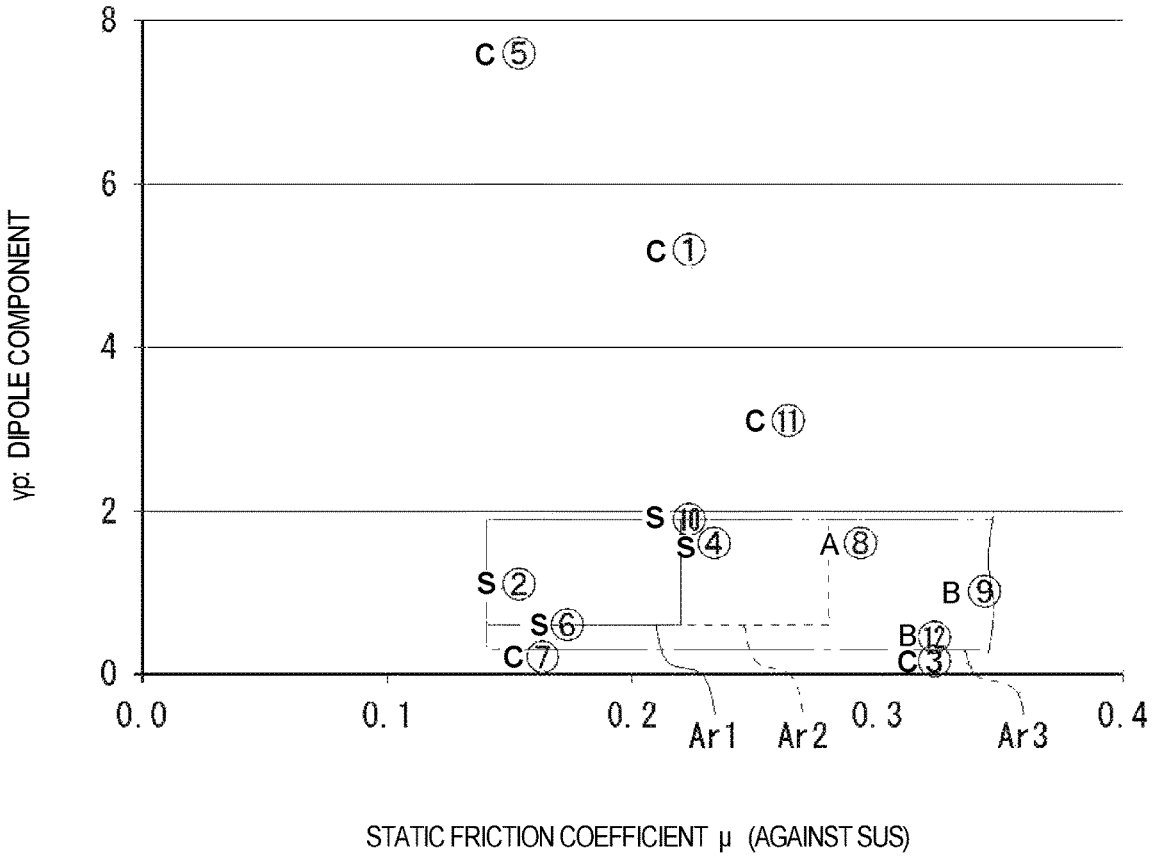
FIG. 5 is a plot diagram illustrating a relationship between the dipole components and the static friction coefficients of the twelve samples of the transfer belt with the overall evaluation thereof.

The relationship between the overall evaluation (S, A, B, C) of each of the twelve samples of the transfer belt 5, and the dipole component and the static friction coefficient (vs. SUS) thereof is illustrated in the plot diagram of FIG. 5. As clearly seen in the plot diagram of FIG. 5 and the table of FIG. 4, four samples of the twelve samples are judged as excellent (marked with "S" in FIGS. 4 and 5), which are the sample No. 2 having the dipole component of 1.1 and the static friction coefficient of 0.14, the sample No. 4 having the dipole component of 0.8 and the static friction coefficient of 0.22., the sample No. 6 having the dipole component is 0.6 and the static friction coefficient of 0.16, and the sample No. 10 having the dipole component of 1.9 and the static friction coefficient of 0.21.

Accordingly, as illustrated as the range Ar1 in FIG. 5, it is understand that setting the dipole component in the range of not less than 0.6 dyn/cm and not greater than 1.9 dyn/cm and the static friction coefficient in the range of not less 0.14 and not greater than 0.22 makes it difficult for the glue of the label paper to be adhered to the surface of the transfer belt 5, makes it easy to remove the glue attached to the surface of the transfer belt 5 by the cleaning blade 29, and make it difficult for the cleaning blade 29 to be worn.

Further according to the experimental results, the sample No. 8 having the dipole component of 1.6 and the static friction coefficient of 0.28 is judged as good (marked with "A") on the overall evaluation. Accordingly, as illustrated as the range Ar2 in FIG. 5, it is understand that setting the dipole component in the range of not less than 0.6 dyn/cm and not greater than 1.9 dyn/cm and the static friction coefficient may in the range of not less 0.14 and not greater than 0.28 make it difficult for the glue of the label paper to be adhered to the surface of the transfer belt 5 and make it easy to remove the glue attached to the surface of the transfer belt 5 by the cleaning blade 29 (without considering the wear property of the cleaning blade 29).

Further according to the experimental results, the sample No. 9 having the dipole component of 1.0 and the static friction coefficient of 0.33 and the sample No. 12 having the dipole component of 0.3 and the static friction coefficient of 0.31 are judged as slightly good (marked with "B") on the overall evaluation. Accordingly, as illustrated as the range Ar3 in FIG. 5, it is understand that setting the dipole component in the range of not less than 0.3 dyn/cm and not greater than 1.9 dyn/cm makes it difficult for the glue of the label paper to be adhered to the surface of the transfer belt 5 (without considering the glue spread onto the surface of the transfer belt 5 and the wear property of the cleaning blade 29). Note that the adhesion property of the glue of the label paper to the surface of the transfer belt 5 is determined based on the dipole component. Thus, the range of the static friction coefficient of the surface of the transfer belt 5 may not require to be set, in order only to make it difficult for the glue of the label paper to be adhered to the surface of the transfer belt 5.

Note that, if the dipole component is larger than 1.9 dyn/cm, the adhesion force of the glue to the surface of the transfer belt 5 becomes strong, and thus the glue easily adheres to the surface of the transfer belt 5, so that the glue adhesion to the surface of the transfer belt 5 is not evaluated as good. If the dipole component is less than 0.3 dyn/cm, the adhesion force of the glue to the surface of the transfer belt 5 is weak, but the toner is hardly adhered to the surface of the transfer belt 5, so that the transferability to the surface of the transfer belt 5 is not evaluated as good.

Further, if the static friction coefficient is greater than 0.28, the static friction coefficient on the surface of the transfer belt 5 is too large, and the glue is spread (rubbed) against the surface of the transfer belt 5, and therefore, good evaluation is not given to the glue spread on the surface of the transfer belt 5. Further, the transfer belt 5 having the static friction coefficient of less than 0.14 is difficult to be manufactured. Therefore, the transfer belt 5 having the static friction coefficient of less than 0.14 cannot be prepared in the first place.

Based on the experimental results, the image formation apparatus 1 according to an embodiment is configured having a specific range of the dipole component of the surface of the transfer belt 5 and a specific range of the static friction coefficient (vs. SUS) of the surface of the transfer belt 5. Specifically, in an embodiment, the dipole component of the surface of the transfer belt 5 is set in the range of not less than 0.6 dyn/cm and not greater than 1.9 dyn/cm and the static friction coefficient of the surface of the transfer belt is set in the range of not less 0.14 and not greater than 0.22.

With this configuration, the image forming apparatus 1 can make it difficult for the glue of the label paper to be adhered to the surface of the transfer belt 5, facilitate removal of the glue attached to the surface of the transfer belt 5 by the cleaning blade 29, and make it difficult for the blade 29 to be worn.

Note that in one or more embodiments described above, the dipole component of the surface of the transfer belt 5 is set in the range of not less than 0.6 dyn/cm and not greater than 1.9 dyn/cm and the static friction coefficient of the surface of the transfer belt is set in the range of not less 0.14 and not greater than 0.22. However, the invention is not limited to this. For example, if it is not necessary to consider the wear of the cleaning blade 29, the range of the static friction coefficient of the surface of the transfer belt can be extended to the range of not less 0.14 and not greater than 0.28, while maintaining the range of the dipole component on the surface of the transfer belt 5 in the range of not less than 0.6 dyn/cm and not greater than 1.9 dyn/cm. Even in this case, the glue of the label paper is difficult to be adhered to the surface of the transfer belt 5, and the glue attached to the surface of the transfer belt 5 can be easily removed by the cleaning blade 29.

Further, if it is preferable that the glue of the label paper is not to be easily adhered to the surface of the transfer belt 5 but it is not necessary to consider the glue spread on the surface of the transfer belt 5 and the wear of the cleaning blade 29, for example, only the dipole component on the surface of the transfer belt 5 can be set to the range of not less than 0.3 dyn/cm and not larger than 1.9 dyn/cm.

3. Advantages

As described above, the image formation apparatus 1 according to an embodiment is configured including the transfer belt 5 having characteristics in which the dipole component of the surface of the transfer belt 5 is in the range of not less than 0.6 dyn/cm and not greater than 1.9 dyn/cm and the static friction coefficient of the surface of the transfer belt (against SUS) is in the range of not less 0.14 and not greater than 0.22.

With this configuration, the image formation apparatus 1 can make it difficult for the glue of the label paper to be adhered to the surface of the transfer belt 5, facilitate removal of the glue attached to the surface of the transfer belt 5 by the cleaning blade 29, and make it difficult for the cleaning blade 29 to be worn, which prolongs the life of the cleaning blade.

Further, in the image formation apparatus 1 according to an embodiment, the dipole component of the surface of the transfer belt 5 is in the range of not less than 0.6 dyn/cm and not greater than 1.9 dyn/cm and the range of the static friction coefficient of the surface of the transfer belt may be extended to the range of not less 0.14 and not greater than 0.28. Even in this case, it may be still difficult for the glue of the label paper to be adhered to the surface of the transfer belt 5, and facilitate removal of the glue attached to the surface of the transfer belt 5 by the cleaning blade 29. Further, in the image formation apparatus 1 according to an embodiment, only the dipole component of the surface of the transfer belt 5 may be set in the range of not less than 0.3 dyn/cm and not greater than 1.9 dyn/cm. Even in this case, it may be difficult for the glue of the label paper to be adhered to the surface of the transfer belt 5.

In summary, by setting the dipole component of the surface of the transfer belt 5 in the range of not less than 0.3 dyn/cm and not greater than 1.9 dyn/cm, preferably by setting the dipole component of the surface of the transfer belt 5 in the range of not less than 0.6 dyn/cm and not greater than 1.9 dyn/cm and the static friction coefficient of the surface of the transfer belt in range of not less 0.14 and not greater than 0.28, further preferably by setting the dipole component of the surface of the transfer belt 5 in the range of not less than 0.6 dyn/cm and not greater than 1.9 dyn/cm and the static friction coefficient of the surface of the transfer belt in range of not less 0.14 and not greater than 0.22, the image formation apparatus can suppress the adhesion of the glue to the transfer belt and thus can suppress deterioration of the image due to the adhesion of the glue.

4. Other Embodiments

4-1. Other Embodiment 1

In the above-described one or more embodiments, the transfer unit 8 includes the transfer belt 5, the primary transfer roller 6, the secondary transfer part 7, the drive roller 24, the idle roller 25, and the gear 27. However, the invention is not limited to this. For example, the transfer unit may include only at least the transfer belt 5 and the components disposed on the back surface (that is, the inner I surface) side of the transfer belt 5.

4-2. Other Embodiment 2

In the above-described one or more embodiments, the urethane cleaning blade 29 is used as a cleaning member for removing the deposits (residual toner, glue, etc.) adhered to the transfer belt 5. However, the invention is not limited to this and other cleaning members may be used. For example, a cleaning brush or the like may be used instead of the cleaning blade 29. Note that in a case where a cleaning member other than the cleaning blade 29 is used, the effective range of the static friction coefficient of the surface of the transfer belt (the range of not less 0.14 and not greater than 0.28, or the range of not less 0.14 and not greater than 0.22) might be changed. Accordingly, in this case, it may only need to set the dipole component of the surface of the transfer belt 5 in the range of not less than 0.3 dyn/cm and not greater than 1.9 dyn/cm.

4-3. Other Embodiment 3

Further, in the above-described one or more embodiments, the invention is applied to the image formation apparatus 1 that is an intermediate transfer type color printer. However, the invention is not limited to this. For example, the invention may be applied to an intermediate transfer type image formation apparatus having a configuration different from that of the above-described image formation apparatus 1. Thus, the invention may be applied to an image formation apparatus that is a monochrome printer, an image formation apparatus dedicated to a roll medium, or the like. Further, the invention may not be limited to a printer, and may be applied to an image formation apparatus such as a copying machine, a facsimile machine, or a multifunction peripheral (MFP), or the like.

4-4. Other Embodiment 4

In the above-described one or more embodiments, the transfer unit 8 is provided with the primary transfer roller 6 as an example of a primary transfer member. However, the invention is not limited to this, and any transfer member different from the primary transfer roller 6 may be provided in the transfer unit 8 as long as the developer image can be transferred to the transfer belt 5. Further, in the above-described one or more embodiments, the secondary transfer roller 26 is provided in the transfer unit 8 as an example of a secondary transfer member. However, the invention is not limited to this. For example, a secondary transfer member different from the secondary transfer roller 26 may be provided in the transfer unit 8 as long as the secondary transfer member can transfer the developer image to the transfer belt 5.

4-5. Other Embodiment 5

Furthermore, the invention is not limited to the above-described one or more embodiments. That is, the scope of the invention extends to embodiments in which some or all of the above-described one or more embodiments are arbitrarily combined, and embodiments in which a part of the above-described one or more embodiments and modifications is extracted.

Embodiments can be widely used in an intermediate transfer type image formation apparatus.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A transfer belt comprising a surface to which a developer image is to be transferred and from which the transferred developer image is to be transferred to a medium, wherein a dipole component of the surface of the transfer belt is not less than 0.3 dyn/cm and not larger than 1.9 dyn/cm.

2. The transfer belt according to claim 1, wherein the dipole component of the surface of the transfer belt is not less than 0.6 dyn/cm and not larger than 1.9 dyn/cm, and a static friction coefficient of the surface of the transfer belt with respect to a stainless steel is not less than 0.14 and not greater than 0.28.

3. The transfer belt according to claim 1, wherein the dipole component of the surface of the transfer belt is not less than 0.6 dyn/cm and not larger than 1.9 dyn/cm, and a static friction coefficient of the surface of the transfer belt with respect to a stainless steel is not less than 0.14 and not greater than 0.22.

4. The transfer belt according to claim 1, wherein a cleaning member to remove a matter attached on the surface of the transfer belt is in contact with the surface of the transfer belt.

5. A transfer unit comprising:

the transfer belt according to claim 1;

a primary transfer member provided on a back side of the transfer belt and configured to transfer the developer image formed by an image formation unit from the image formation unit onto the transfer belt; and a secondary transfer member provided on the back side of the transfer belt and configured to transfer the developer image transferred to the transfer belt from the transfer belt to a medium.

6. An image formation apparatus comprising the transfer unit according to claim 5.

7. An image formation apparatus comprising an image formation unit including an image carrier and configured to form a developer image on the image carrier;

the transfer belt according to claim 1;

a primary transfer member provided in the vicinity of the transfer belt and configured to transfer the developer image formed by the image formation unit from the image formation unit onto the transfer belt; and a secondary transfer member provided in the vicinity of the transfer belt and configured to transfer the developer image transferred to the transfer belt from the transfer belt to a medium.

* * * * *